US005685209A

United States Patent [19]

Fiedler

[11] Patent Number: 5,685,209

[45] Date of Patent: Nov. 11, 1997

[54] GARBAGE DISPOSAL UNJAMMING DEVICE

[76] Inventor: Paul H. Fiedler, P.O. Box 6496, Bridgewater, N.J. 08807

[21] Appl. No.: 546,140

[22] Filed: Oct. 20, 1995

[51] Int. Cl.[6] ..... B25B 13/48

[52] U.S. Cl. ..... 81/436; 81/176.1

[58] Field of Search ..... 81/488, 436, 176.1, 81/176.15; 29/240

[56] References Cited

U.S. PATENT DOCUMENTS

| | | | |
|---|---|---|---|
| 2,803,981 | 8/1957 | Stoecker | 81/176.15 |
| 3,213,720 | 10/1965 | Wallis et al. . | |
| 4,050,334 | 9/1977 | Davis, Jr. . | |
| 5,090,276 | 2/1992 | Groskey | 81/436 |

*Primary Examiner*—D. S. Meislin
*Assistant Examiner*—Joni B. Danganan
*Attorney, Agent, or Firm*—Kenneth P. Glynn, Esq.

[57] ABSTRACT

The present invention is directed to a garbage disposal unjamming device which enables a user to easily unjam a garbage disposal by rotation of blades. The present invention garbage disposal unjamming device has a shaft with a first end and a second end opposite one another. The elongated shaft has a handle connected to the first end. At the second end of the shaft is a flat plate having a straight bottom edge and an upper edge, which is hingedly connected to the second end of shaft at a location below the upper edge of the flat plate. The flat plate has a first position wherein the bottom edge forms right angles with the shaft and a second position wherein the bottom edge of the plate forms an acute angle on one side of the shaft and an obtuse angle on the opposite side of the shaft. Thus, when the plate is in its first position the device can fit into an opening of a first, predetermined size and, when the plate is in its second position the device can fit into an opening of a different predetermined size being less than the first predetermined size. The device also includes a biasing mechanism which may be, e.g., a spring or off-centered weight of the flat plate so as to maintain the flat plate in its second position.

4 Claims, 2 Drawing Sheets

GARBAGE DISPOSAL UNJAMMING DEVICE

BACKGROUND OF THE INVENTION

1. Field of the Invention

The present invention is directed to a device for unjamming sink garbage disposal systems. Typically, such systems have blades within the drain of the sink which rotate to mutilate garbage and render it into a fine segment so as to be easily washed down into the drain and into the sewage system. The blades typically are riveted, bolted or otherwise attached with means which protrude upwardly and have substantially flat surfaces. The present invention device uniquely has the ability to be fitted down into a narrower drain opening and to "spread" open inside the drain so that a flat plate of the present invention device can then be rotated to engage the protrusions, bolts, studs, rivets or other attachment mechanism for the blades, and, by rotation of the present invention device, its flat plate will force the rotation of the shaft of the disposal and the blades and will disengage jamming which may have occurred through unsuccessful mutilation of garbage being disposed therein.

2. Information Disclosure Statement

Automatic garbage disposals are used in many homes today in the kitchen so as to combine food waste with drainage waste. Such devices eliminate the need for dumping garbage into a separate trash can, removing the garbage, having it picked up, paying for it and so forth. Such devices also put food, which is typically biodegradable, into the waste disposal system where bacteria and other natural evolution of waste may occur.

Problems do arise, however, due to the fact that certain foods will not be easily rendered and may jam the device and/or inappropriate waste is put down the drain and jams the device. There seems to be two predominate methods of unjamming garbage disposals today, as follows:

1. Either using a hand, or using something like a screwdriver or other elongated tool, the user will try to force the jammed material out of the blades and then continuously turn the device off and on. This method may result in unsuccessful unjamming, or, worse, injury to the party trying to unjam it or burn-out of the motor or a combination of these;
2. A plumber is called and the plumber will use various tools to take apart the garbage disposal device and dislodge it, involving loss of time by the homeowner and expense being paid unnecessarily to the plumber.

The present invention device is a single tool which uniquely has a narrow width or diameter for insertion into a sink with a blade that rotates so as to be wider when inserted, so as to enable the user to rotate blades and scrape out jammed material. It is believed that there is no device which is similar or the same which would render the present invention unpatentable or obvious.

Notwithstanding the prior art, the present invention is neither taught nor rendered obvious thereby.

SUMMARY OF THE INVENTION

The present invention is directed to a garbage disposal unjamming device which enables a user to easily unjam a garbage disposal by rotation of blades, without using complex tools, without taking apart the disposal system and without the need to call a professional plumber. The present invention garbage disposal unjamming device has a shaft with a first end and a second end opposite one another. The elongated shaft has a handle connected to the first end. At the second end of the shaft is flat plate having a straight bottom edge and an upper edge, which is hingedly connected to the second end of shaft at a location below the upper edge of the flat plate. The flat plate has a first position wherein the bottom edge forms right angles with the shaft and a second position wherein the bottom edge of the plate forms an acute angle on one side of the shaft and an obtuse angle on the opposite side of the shaft. Thus, when the plate is in its first position the device can fit into an opening of a first, predetermined size and, when the plate is in its second position the device can fit into an opening of a second predetermined size being less than the first predetermined size. The device also includes biasing means which may be a spring or mere off-centered weight of the flat plate so as to maintain the flat plate in its second position. Thus the device is inserted into a sink drain having a garbage disposal therein and, upon downward pressure against the blades of the garbage disposal, the biasing mechanism yields to allow the plate to be in its first position and to enable a user to rotate the device with the plate against the upwardly extending elements or protrusions of a garbage disposal so as to rotate the blades and the shaft with the garbage disposal system and thereby unjam it.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention is directed to a tool for easily unjamming garbage disposal systems. The device uniquely has a plate which rotates to fit into a narrow opening and then can be "opened" to grip onto protrusions of the garbage disposal system to unjam it. Thus, the device is inserted into a sink drain having a garbage disposal therein and, upon downward pressure against the blades of the garbage disposal, a biasing mechanism yields to allow the plate to be in its first position and to enable a user to rotate the device with the plate against the upwardly extending elements or protrusions of a garbage disposal, so as to rotate the blades and the shaft with the garbage disposal system and thereby unjam it.

Figure 1:
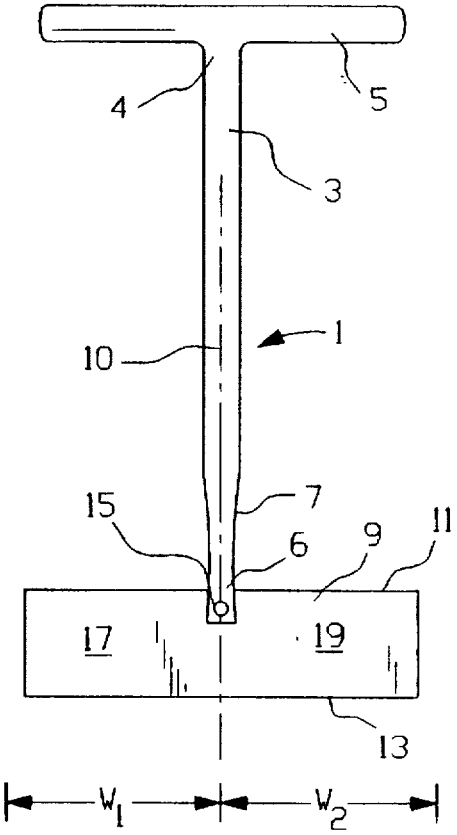
FIG. 1 shows a front view of a present invention device with its flat plate in its first, horizontal position
Figure 2:
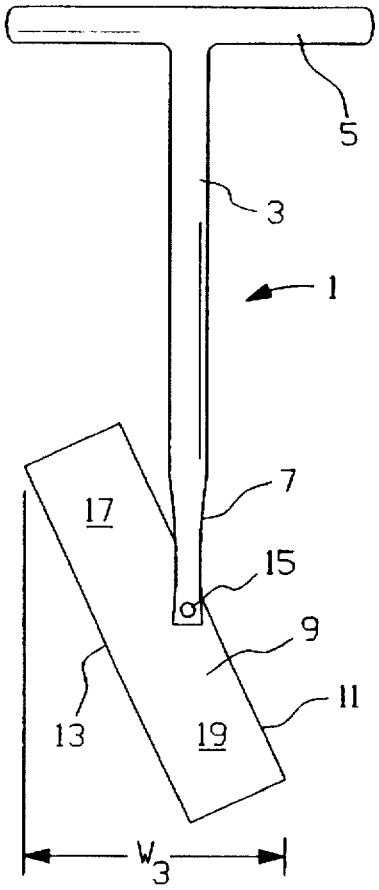
FIG. 2 shows a front view of the same device with its flat plate in its second, non-horizontal position.

Referring now to FIG. 1, there is shown a present invention garbage disposal unjamming device 1 which includes an elongated shaft 3. The shaft 3 has a first end 4 and a second end 6 and located at first end 4 is handle 5 and located at second end 6 is a flat plate 9 having a straight bottom edge 13 and an upper edge 11. Flat plate 9 is hingedly connected to second end 6 of shaft 3 with hinge pin 15, as shown. Since, in this embodiment, present invention device 1 has a hollow tubular elongated shaft 3, it has a cut-out all the way through shown as cut-out 7 so as to enable flat plate 9 to be rotated as more specifically shown in FIG. 2. There is an imaginary center line 10 which passes through the vertical elongation of shaft 3 of present invention 1 and through hinge pin 15. To the left of that is a first portion 17 of flat plate 9 having a width of $W_1$ and an opposite, second portion 19 of flat plate 9 having another width, $W_2$. $W_2$ is greater than $W_1$ and, given a reasonable assumption that the thickness, height, depth and other dimensions of flat plate 9 are consistent, then portion 19 would weigh more than portion 17 and would cause a tendency for flat plate 9 to rotate downwardly at portion 19 and upwardly at portion 17. Thus, FIG. 1 shows a first position of flat plate 9 with bottom edge 13 being horizontal relative to the vertical positioning of elongated shaft 3. In other words, they form approximately a 90° angle relative to one another. As can be seen in FIGS. 1 and 2, shaft 3 and handle 5 are unistructurally formed.

Referring to FIG. 2, there is shown the identical present invention device 1 as shown in FIG. 1, with like parts like numbered. These front views illustrate, in FIG. 1, the first position of flat plate 9 and, in FIG. 2, the second, swung or rotated position of flat plate 9 wherein bottom edge 13 does not form a right angle with the elongated shaft 3. Thus, FIG. 1 represents a first position and FIG. 2 represents a second position. In reality, due to the gravitational pull of portion 19 because it is greater than that of portion 17, when handle 5 is held so that elongated shaft 3 is substantially vertically oriented, because of the free-swinging or rotating aspect of flat plate 9, there is an inherent tendency for the plate 9 to rotate into its second position as shown in FIG. 2. In this case, there is a width $W_3$, which is less than the combined width of $W_1$ and $W_2$ and enables a user to pass present invention device 1 through an opening which is less than that which would be passable if the present invention device 1 were maintained in its first position as shown in FIG. 1. This is more fully illustrated in conjunction with the discussion of FIGS. 5 and 6 below.

Figure 3:
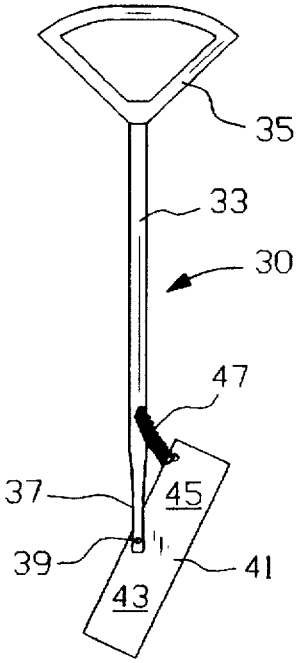
FIG. 3 shows a front view of a present invention device with a spring bias mechanism.

FIG. 3 shows an alternative embodiment present invention device 30 having an elongated shaft 33, handle 35 and, again, a cut-out portion 37 at its lower end. There is a hinge pin 39 and plate 41 with a first portion and second portion 43, and 45 respectively. In this instance, portions 43 and 45 may be equal, but spring 47 biases plate 41 upwardly into its second position. When the present invention device 30 is passed through a sink drain and then on downward to a garbage disposal system and pressure is put on handle 35, spring 47 will yield so that flat plate 41 rotates into its horizontal position and may be utilized as would be device 1 shown in FIG. 1 above and described in conjunction with FIGS. 5 and 6 below.

Figure 4:
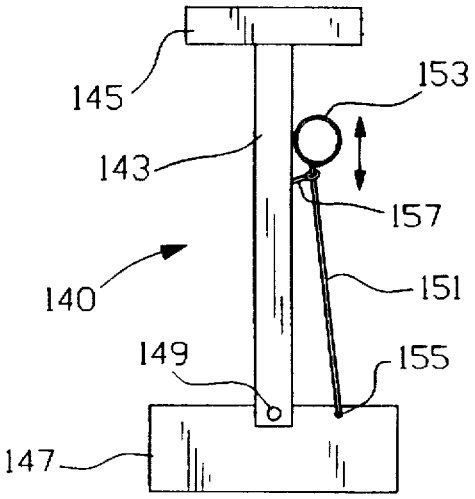
FIG. 4 shows a front view of an alternative embodiment present invention having a pull rod biasing mechanism.

FIG. 4 shows yet another alternative embodiment of the present invention. Here device 140 has an elongated shaft 143, handle 145 and a hinge pin 149. Plate 147, in this case, has a second connection at opening 155 with pull rod 151. Pull rod 151 has a finger ring 153 and it has a guide loop 157, as shown. A user may hold handle 145, place a finger in finger ring 153 and pull upwardly or push downwardly to rotate plate 147 into and out of the horizontal position. In other words, by pulling finger ring 153 upwardly and rotating plate 147 accordingly so as to create one acute angle and one obtuse angle with the vertical dimension of shaft 143, a width such as is shown in FIG. 2 will be achieved and the flat plate 147 of device 140 could then fit through a narrower opening then would otherwise be achieved if plate 147 were permanently fixed in a position 90° relative to elongated shaft 143.

Figure 6:
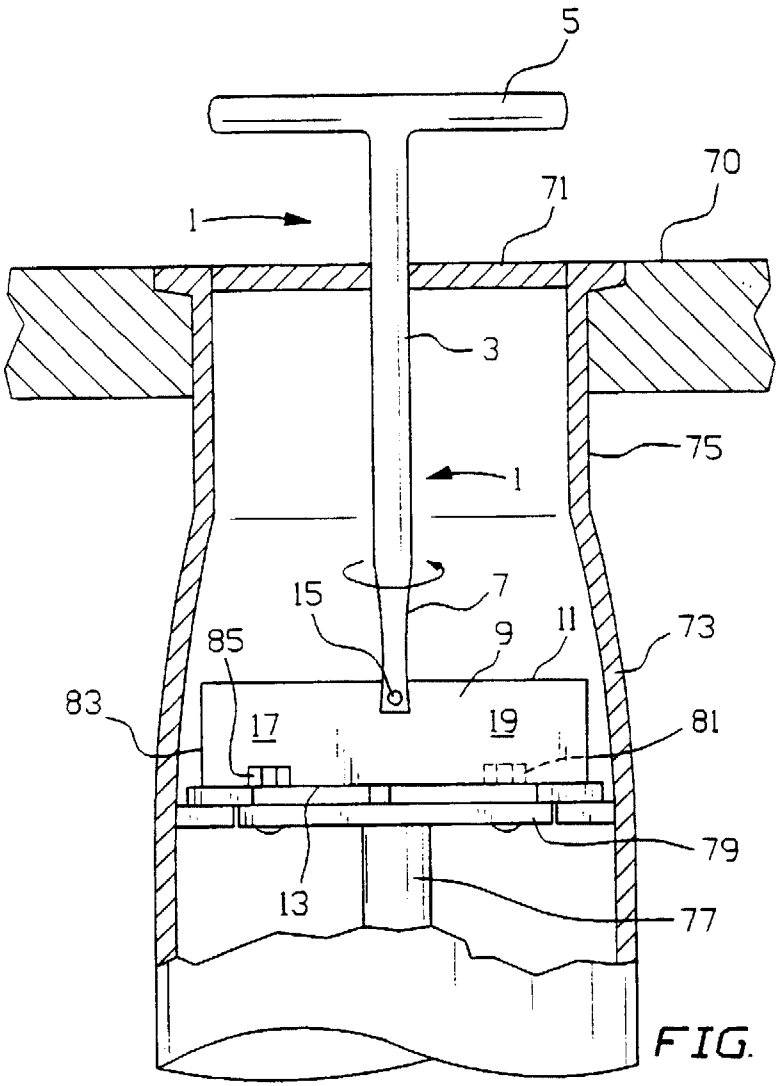
FIGS. 5 and 6 ;slow a front cut view of a sink, drain and garbage disposal system with present invention device 1 being inserted, and then rotated therein, respectively.
Figure 5:
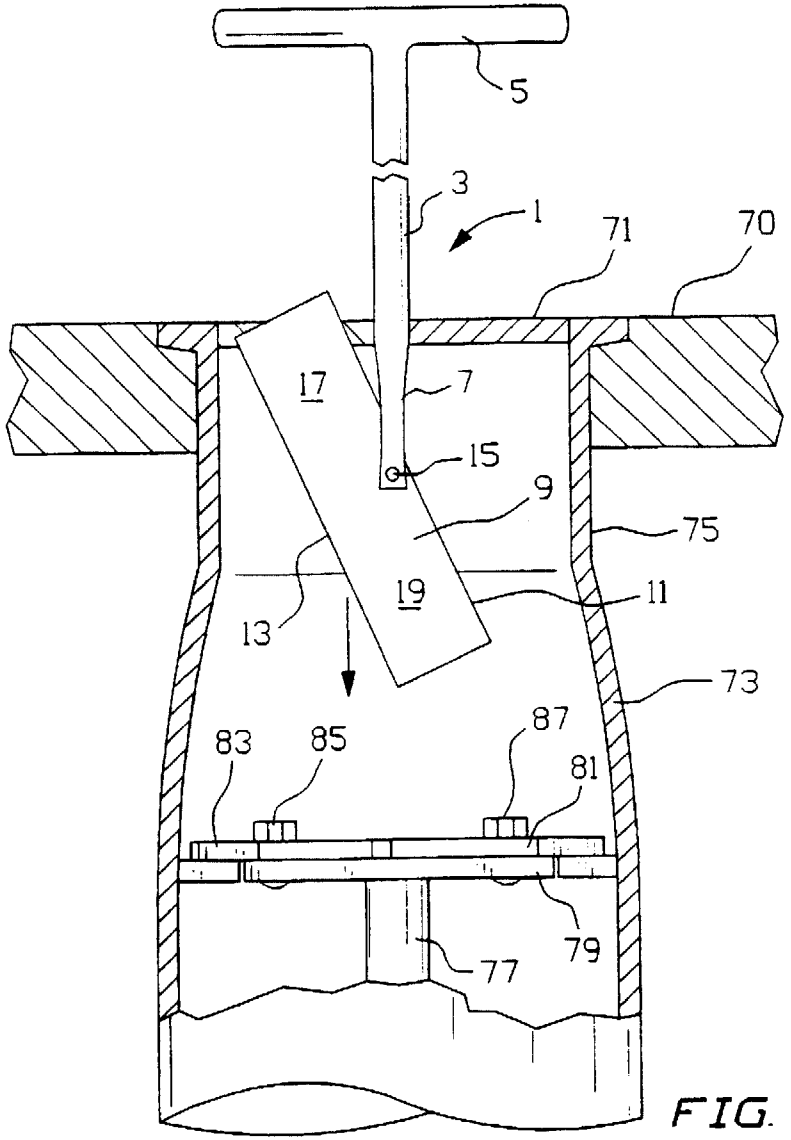

FIGS. 5 and 6 taken together show a cut front view of a present invention device being inserted and then being used to free the blades and therefore a garbage disposal system. Here, present invention device 1 is shown in both figures and like parts are like numbered. As shown in FIG. 5, present invention device 1 has its plate 9 maintained in its second position (non-horizontal) so that it may fit through the narrower opening of drain 71 in sink drain 70. Constricted pipe portion 75 opens up into a wider section 73 wherein a typical garbage disposal system represented by its elements such as shaft 77, plate 79 and blades 81 and 83, are shown. Blades such as blades 81 and 83 are maintained by nuts 85 and 87 and, when such a device is jammed through stuck food, it is difficult to rotate same and, typically, the motor may burn out or will otherwise lock-up so as to cause extensive damage. Thus, the present invention device 1 is inserted as shown in FIG. 5 and, when maintained with pressure against blades 81 and 83, flat plate 9 rotates into its first position as shown in FIG. 6 (horizontal). While maintaining pressure thereon, a user may rotate handle 5 and thereby rotate shaft 3 and flat plate 9. Flat plate 9 at its lower edge 13 will press against protrusions such as nuts 85 and 87, as shown. This enables rotational pressure to be applied and blades are rotated and the stuck food or other material is dislodged thereby unjamming the disposal for subsequent use. By lifting upwardly on handle 5, gravity automatically rotates flat plate 9 back into its second position such as is shown in FIG. 5 and it may be easily removable from the drain.

Obviously, numerous modifications and variations of the present invention are possible in light of the above teachings. It is therefore understood that within the scope of the appended claims, the invention may be practiced otherwise than as specifically described herein.

What is claimed is:

1. A garbage disposal unjamming device, which comprises:

a) an elongated shaft, said shaft having a first end and second end opposite one another;

b) a handle connected to said first end of shaft;

c) a flat plate having a straight bottom edge and an upper edge and being hingedly connected to said second end of said shaft at a location below said upper edge, said plate having a first position wherein said bottom edge forms right angles with said shaft and a second position wherein said bottom edge of said plate forms an acute angle on one side of said shaft and an obtuse angle on an opposite side of said shaft, such that when said plate is in first position, said device can fit into an opening of a first predetermined size, and when said plate is in second position, said device can fit into an opening of a second predetermined size, said second predetermined size being less than said first predetermined size;

d) biasing means for biasing said plate into said second position, such that said device may be inserted into a sink drain having a garbage disposal therein and, upon downward pressure against blades of a garbage disposal, said biasing means yields to allow said plate to be in said first position and to enable a user to rotate said device with said plate against upwardly extending elements of a garbage disposal so as to rotate same and thereby unjam same;

e) a slidable pull rod slidably connected to said elongated shaft and hingedly connected to said flat plate so as to be used to hold said flat plate in its first position and, to move said flat plate such that when said pull rod is pulled and pushed, the flat plate is rotatably moved so as to be held in said first position or said second position with said pull rod as a user may desire; and, further, wherein said flat plate is hingedly connected to said second end of said shaft whereby an imaginary center line running down said shaft and through said flat plate designates a first side of said flat plate to one side of said imaginary center line and a second side of said flat plate on the opposite side of said imaginary center line and one of said first side of said flat plate and said second side of said flat plate is heavier than the other, and, the excess weight on one of said flat plate sides is a biasing means for rotating one side of said flat plate upwardly and the other downwardly by gravity.

2. The garbage disposal unjamming device of claim 1 wherein said handle and shaft are unistructurally formed.

3. A garbage disposal unjamming device, which comprises:

a) an elongated shaft, said shaft having a first end and second end opposite one another;

b) a handle connected to said first end of shaft;

c) a flat plate having a straight bottom edge and an upper edge and being hingedly connected to said second end of said shaft at a location below said upper edge, said plate having a first position wherein said bottom edge forms right angles with said shaft and a second position wherein said bottom edge of said plate forms an acute angle on one side of said shaft and an obtuse angle on an opposite side of said shaft, such that when said plate is in first position, said device can fit into an opening of a first predetermined size, and when said plate is in second position, said device can fit into an opening of a second predetermined size, said second predetermined size being less than said first predetermined size;

d) biasing means for biasing said plate into said second position, such that said device may be inserted into a sink drain having a garbage disposal therein and, upon downward pressure against blades of a garbage disposal, said biasing means yields to allow said plate to be in said first position and to enable a user to rotate said device with said plate against upwardly extending elements of a garbage disposal so as to rotate same and thereby unjam same; and, further, wherein said plate is hingedly connected to said second end of said shaft with an imaginary center line running through said shaft and down through said flat plate, whereby the weight to one side of said imaginary center line of said flat plate is equal to the weight of said flat plate on the other side of said imaginary center line, and, said means for biasing said plate is a spring which biases one-half of said plate rotatably upwardly and the other half of said plate rotatably downwardly.

4. The garbage disposal unjamming device of claim 3 wherein said handle and shaft are unistructurally formed.

* * * * *